US006202412B1

(12) United States Patent
Lange et al.

(10) Patent No.: US 6,202,412 B1
(45) Date of Patent: Mar. 20, 2001

(54) METHOD AND APPARATUS FOR FAULT RECOGNITION IN AN INTERNAL COMBUSTION ENGINE

(75) Inventors: Thomas Lange, Weinstadt; Guenter Driedger, Oberriexingen; Bruno-Hans Dieners, Stuttgart; Peter Lutz, Weinsberg, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 08/939,625

(22) Filed: Sep. 29, 1997

(30) Foreign Application Priority Data

Oct. 11, 1996 (DE) ..... 196 41 942

(51) Int. Cl.[7] ..... F02D 23/00
(52) U.S. Cl. ..... 60/602; 123/198 DB
(58) Field of Search ..... 123/198 DB, 383, 123/371; 60/602

(56) References Cited

U.S. PATENT DOCUMENTS

| | | | | |
|---|---|---|---|---|
| 4,434,761 | * | 3/1984 | Ludwig | 123/383 |
| 4,531,493 | | 7/1985 | Fortnagel | 123/383 |
| 4,633,670 | * | 1/1987 | Iwasa | 60/603 |

FOREIGN PATENT DOCUMENTS

| | | |
|---|---|---|
| 31 29 686 | 2/1983 | (DE) . |
| 38 03 078 | 8/1989 | (DE) . |
| 2 079 364 | 1/1982 | (GB) . |

* cited by examiner

*Primary Examiner*—Noah P. Kamen
(74) *Attorney, Agent, or Firm*—Kenyon & Kenyon

(57) ABSTRACT

A method and apparatus for fault recognition in an internal combustion engine, such as an auto-ignition internal combustion engine. A defect in the metering system is recognized if the boost pressure deviates from an expected value.

14 Claims, 3 Drawing Sheets

METHOD AND APPARATUS FOR FAULT RECOGNITION IN AN INTERNAL COMBUSTION ENGINE

FIELD OF THE INVENTION

The present invention relates to a method and apparatus for fault recognition in an internal combustion engine.

BACKGROUND INFORMATION

A conventional method and apparatus for fault recognition in an internal combustion engine in the region of the high-pressure circuit in the case of a common rail system are described in U.S. Pat. No. 5,241,933. In this method and apparatus, the pressure in the rail is regulated. If the manipulated variable of the pressure regulation circuit lies outside a definable range, the apparatus recognizes a fault.

A disadvantage with this arrangement is that a fault is recognized only in the case of a considerable pressure drop.

A method and device for fault recognition in an internal combustion engine are also described in German Patent Application No. 38 03 078. With this conventional method and apparatus, when the engine is coasting, the actuator which determines the quantity of fuel to be injected is moved to its mechanical stop at which no injection occurs. If, in this operating state, pulses occur at a so-called needle movement sensor, a fault is assumed to exist.

A device for controlling boost pressure in an internal combustion engine operated with turbocharging is described in German Patent Application No. 31 29 686.

One of the objects of the present invention is to be able to recognize faults as reliably as possible using an apparatus for fault recognition in an internal combustion engine.

SUMMARY OF THE INVENTION

It is possible to recognize faults reliably and easily in the area of fuel metering using a method and apparatus according to the present invention. In particular, sticking solenoid valves in the case of solenoid valve-controlled fuel metering devices, or an eccentric detachment in the case of distributor pumps, or a control rod break in the case of in-line pumps can be reliably detected.

DETAILED DESCRIPTION

Figure 1:
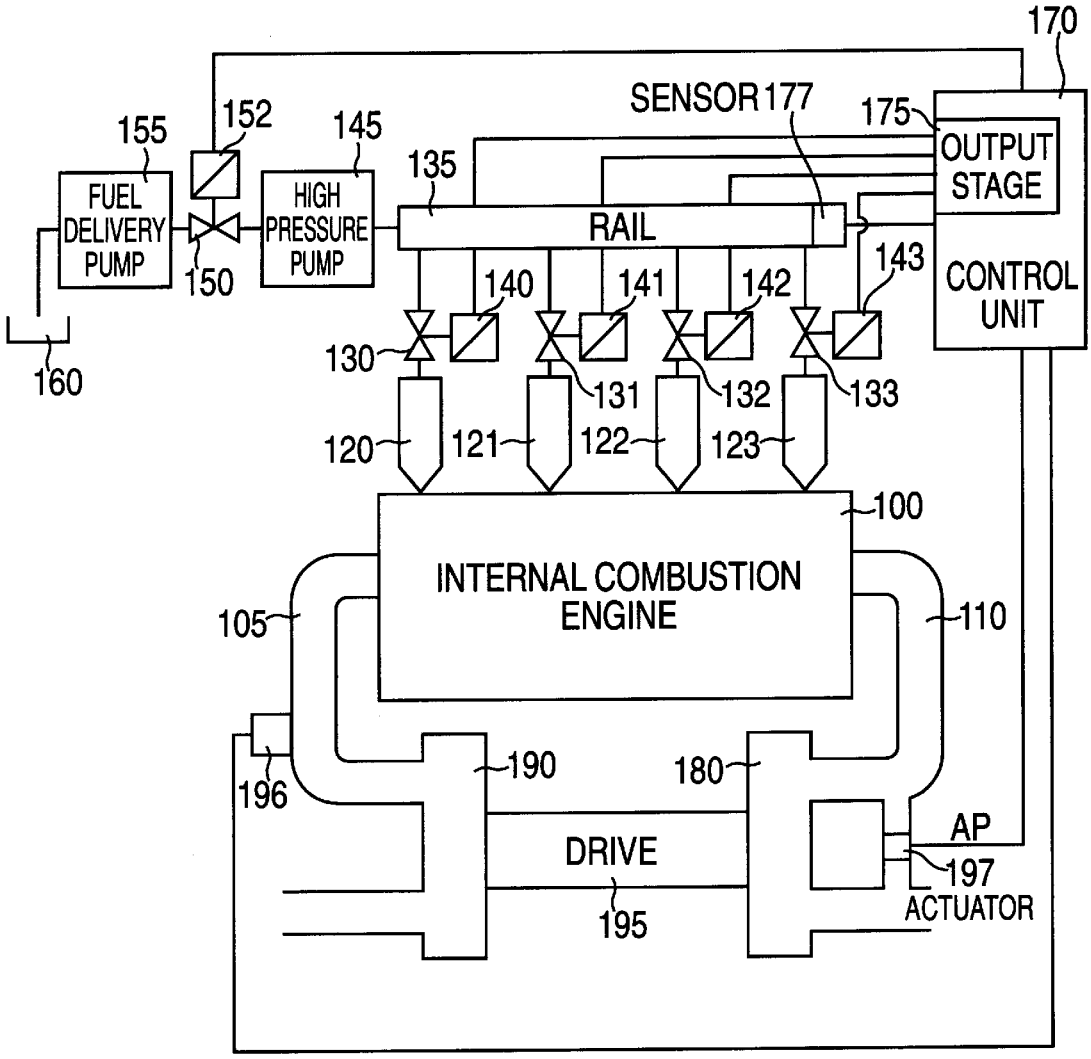
FIG. 1 shows a block diagram of a fuel metering system according to the present invention.

The apparatus according to the present invention will be presented below using the example of an auto-ignition internal combustion engine in which fuel metering is controlled with one or more solenoid valves. An embodiment of a fuel metering system shown in FIG. 1 illustrates a common rail system. The method and apparatus according to the present invention is not, however, restricted to such systems. It can be used with all fuel metering systems. In particular, it is possible to utilize the present invention even with distributor injection pumps, in which the beginning and/or-end of injection are controlled with a solenoid valve.

The procedure according to the present invention can also be utilized in other fuel metering systems, such as, e.g., pump-nozzle systems, pump-line-nozzle systems, distributor pumps, in-line pumps, and spark-ignited internal combustion engines. FIG. 1 shows an internal combustion engine 100 that receives fresh air supplied via an intake duct 105, and emits exhaust gases via an exhaust duct 110. Exhaust duct 110 leads to a turbine 180 of a turbocharger. Turbine 180 is connected via a drive 195 to compressor 190 of the turbocharger. Compressor 190 is in turn in contact with intake duct 105. Arranged in intake duct 105 is a sensor 196 which senses the pressure existing therein, which hereinafter is referred to as the boost pressure PL.

The internal combustion engine depicted in FIG. 1 is a four-cylinder internal combustion engine. The method can also be utilized with an internal combustion engine having other number of cylinders. An injector 120, 121, 122, and 123 is associated with each cylinder of the internal combustion engine 100. Fuel is metered to the injectors via solenoid valves 130, 131, 132, and 133. The fuel passes from a rail 135, via injectors 120 to 123, into the cylinders of internal combustion engine 100. The fuel in rail 135 is brought to an adjustable pressure by a high-pressure pump 145. High-pressure pump 145 is connected via a solenoid valve 150 to a fuel delivery pump 155. Fuel delivery pump 155 is in contact with a fuel reservoir 160.

Solenoid valve 150 includes a coil 152. Solenoid valves 130 to 133 contain coils 140, 141, 142, and 143, which can have current applied to them using an output stage 175. Output stage 175 is preferably arranged in a control unit 170 which also triggers coil 152. A sensor 177 which senses the pressure in rail 135 and sends a corresponding signal to control unit 170 is also provided.

A duct through which exhaust gas can be routed around compressor 180 is connected in parallel with the compressor. A pressure in the cross section of this duct can be controlled by control unit 170 with an actuator for boost pressure 197 using a triggering signal AP. Triggering signal AP determines the position of actuator 197 and thus the opening cross section of the bypass duct. Differences in the pulse duty cycle of signal AP result in differences in the exhaust gas volumes that are not used to drive the turbine. Such actuators 197 are usually referred to as "waste gates."

This device operates as follows: Fuel delivery pump 155 delivers fuel from the reservoir via valve 150 to high-pressure pump 145. High-pressure pump 145 builds up a definable pressure in rail 135. Pressures greater than 800 bar are usually built up in rail 135. The corresponding solenoid valves 130 to 133 are triggered by applying current to coils 140 to 143. The triggering signals for the coils define the beginning and the end of injection of the fuel through injectors 120 to 123. The triggering signals are generated by control device 170 as a function of various operating conditions, e.g., user definable parameters, engine speed, and/or other variables.

If one of solenoid valves 130 to 133 does not close and/or open correctly, an impermissible injection of fuel into the internal combustion engine may occur. This can cause the internal combustion engine to accelerate unintentionally. Damage can also occur due to overheating of the internal combustion engine, excessive engine speed, and/or impermissible combustion pressure.

For solenoid valve-controlled distributor injection pumps, a solenoid valve is generally provided which is arranged so that an injection takes place when the solenoid valve is closed. If the solenoid valve remains closed or maintains an unfavorable intermediate position, an impermissible injection of fuel may also occur.

The exhaust gas produced in internal combustion engine 100 drives turbine 180 of the turbocharger. The quantity of driving exhaust gas can be influenced using actuator (or adjuster) 197. Other adjusters which influence the boost pressure can also be used instead of actuator 197. For example, it is also possible to influence drive 195 correspondingly. In addition, the geometry of the turbine blades can be adjusted in order to influence the boost pressure. Compressor 190 is correspondingly driven by turbine 180 using drive 195. The compressor compresses the air that is taken in. Sensor 196 senses the pressure in intake duct 105 between the internal combustion engine and the compressor.

According to the present invention, it has been recognized that the pressure PL and/or the rate of change, hereinafter to be referred to merely as 'change' in the pressure in intake duct 105 can be utilized as an indication of uncontrolled injections into the internal combustion engine. An increased injection volume causes an increase in the exhaust gas volume which drives the turbine, so that the pressure PL also rises. If the boost pressure and/or the change in boost pressure deviates from an expected value, a fault is recognized and suitable action is taken.

Figure 2:
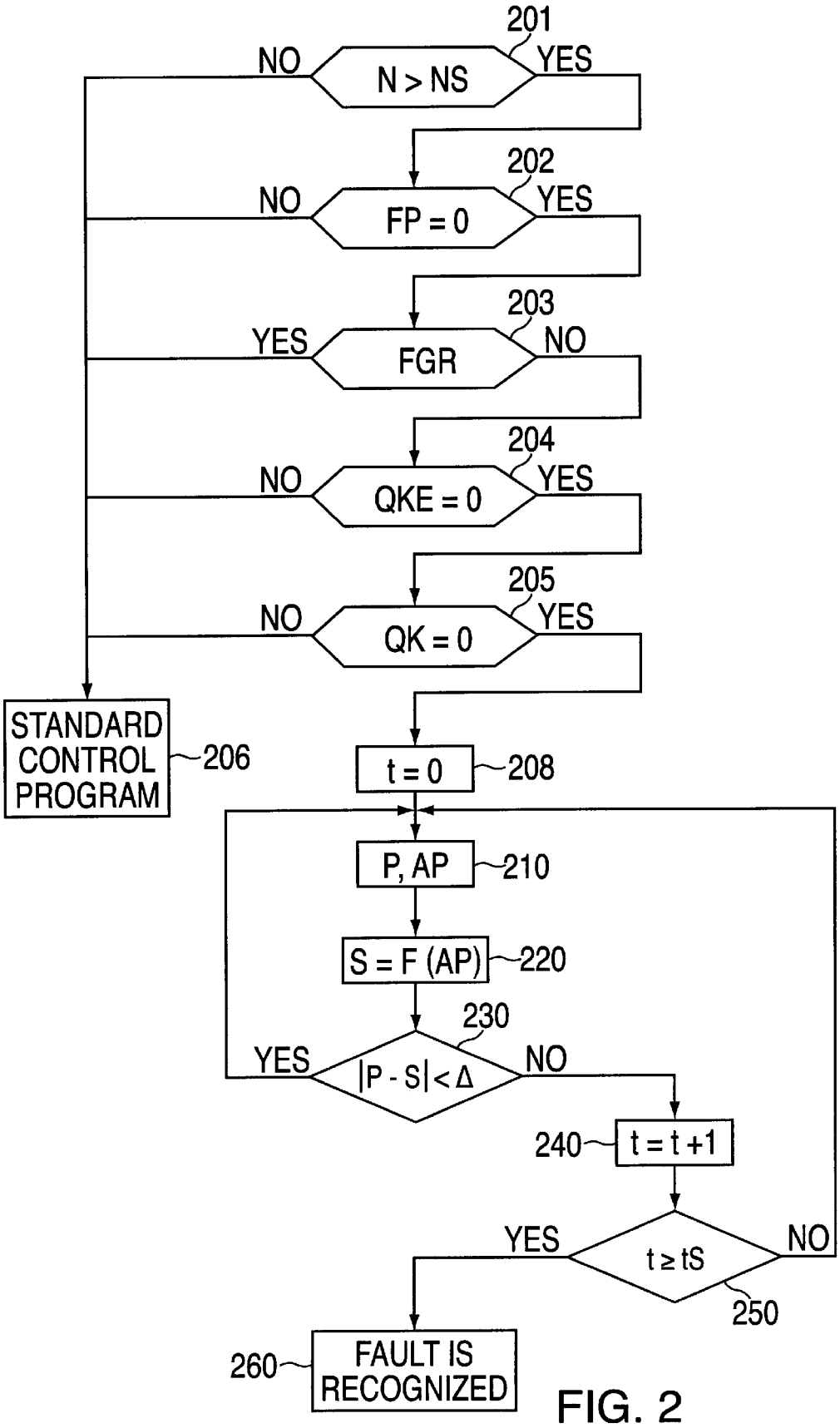
FIG. 2 shows a flow diagram of a first embodiment of the method according to the present invention.

One possible implementation of this method is shown in FIG. 2 as a flow diagram.

According to the present invention, a check is made as to whether the boost pressure acquires an expected value in a given state. If this is not the case, a fault is recognized. The state selected as the operating state is one in which, in the absence of a fault, no injection of fuel into the internal combustion engine occurs.

In a first query 201, a check is made as to whether the starting operation is complete, and a so-called start bit is erased. For this purpose, a check is also made, for example, as to whether engine speed N is greater than the starting engine speed NS. If this is not the case, step 206 then follows, by transitioning to the standard control program. Once the starting operation has been correctly completed, and/or once the engine speed N is greater than the starting engine speed NS, next query 202 checks whether the accelerator pedal is being actuated. For this purpose, a check is made, for example, as to whether the accelerator pedal position FP is equal to 0. If this is not the case, step 206 again follows.

Otherwise query 203 checks whether a vehicle speed regulator is active. If this is the case, step 206 again follows. If a vehicle speed regulator is not active, query 204 then follows, which checks whether an external quantity intervention is present. Such an external quantity intervention can be requested, for example, by a transmission controller and/or an engine drag control system. For this purpose, a check is made as to whether the external quantity request QKE is equal to 0. If this is not the case, step 206 again follows.

Otherwise, query 205 then follows, which checks whether the fuel quantity QK to be injected, as defined by controller 170, is equal to 0. If this is not the case, step 206 then follows. If the fuel quantity QK to be injected is equal to 0, the actual fault check begins in step 208.

All of the above queries can be processed. It is also possible for individual queries to be excluded. For example, in vehicles without external quantity intervention or with a vehicle speed regulator, the corresponding queries can be omitted.

In step 208, a counter t is set to 0. Then, in step 210, the present boost pressure P and the triggering signal AP for application to actuator 197 are acquired.

In step 220, an expected value S for the boost pressure is acquired, preferably from a characteristics diagram, as a function F of the triggering signal AP, speed N of the internal combustion engine and/or other operating parameters. The subsequent query 230 checks whether the magnitude of the difference between the measured boost pressure and the value S is less than Δ. If this is the case, step 210 again follows.

Otherwise, i.e. if the boost pressure deviates from the expected value for the boost pressure, time counter t is then incremented by 1 in step 240. Query 250 checks whether time counter t is greater than or equal to a threshold value tS. If this is not the case, step 210 follows again; if it is the case, a fault is recognized in step 260, and corresponding actions are initiated.

According to the present invention, when a suitable operating state, e.g., coasting, is present as recognized by queries 201 and 205, the measured boost pressure is compared with an expected value S. If this value does not agree with the expected value, i.e. if an elevated boost pressure is measured, then fuel is being injected even though the engine is coasting. The conclusion drawn from this is that the quantity-determining solenoid valve is operating incorrectly. If the above conditions are met, then after the bounce time ts has elapsed, corresponding fault actions are initiated to effect a reduction in the power output of the internal combustion engine.

It is possible for a throttle valve arranged in the intake duct which throttles the intake air to be triggered so that the engine speed decreases to a maximum permissible value. As a further action, provision can be made for the reference quantity for the fuel quantity controller to be set to zero. It is particularly advantageous if a shutoff valve is provided which is arranged in the fuel inflow before the pump, or in the pump. This is then triggered in such a way that the engine speed decreases to a safe value, or the internal combustion engine is shut down. In addition, the injection actuator can be retarded. Furthermore, a fault memory is set accordingly.

Figure 3:
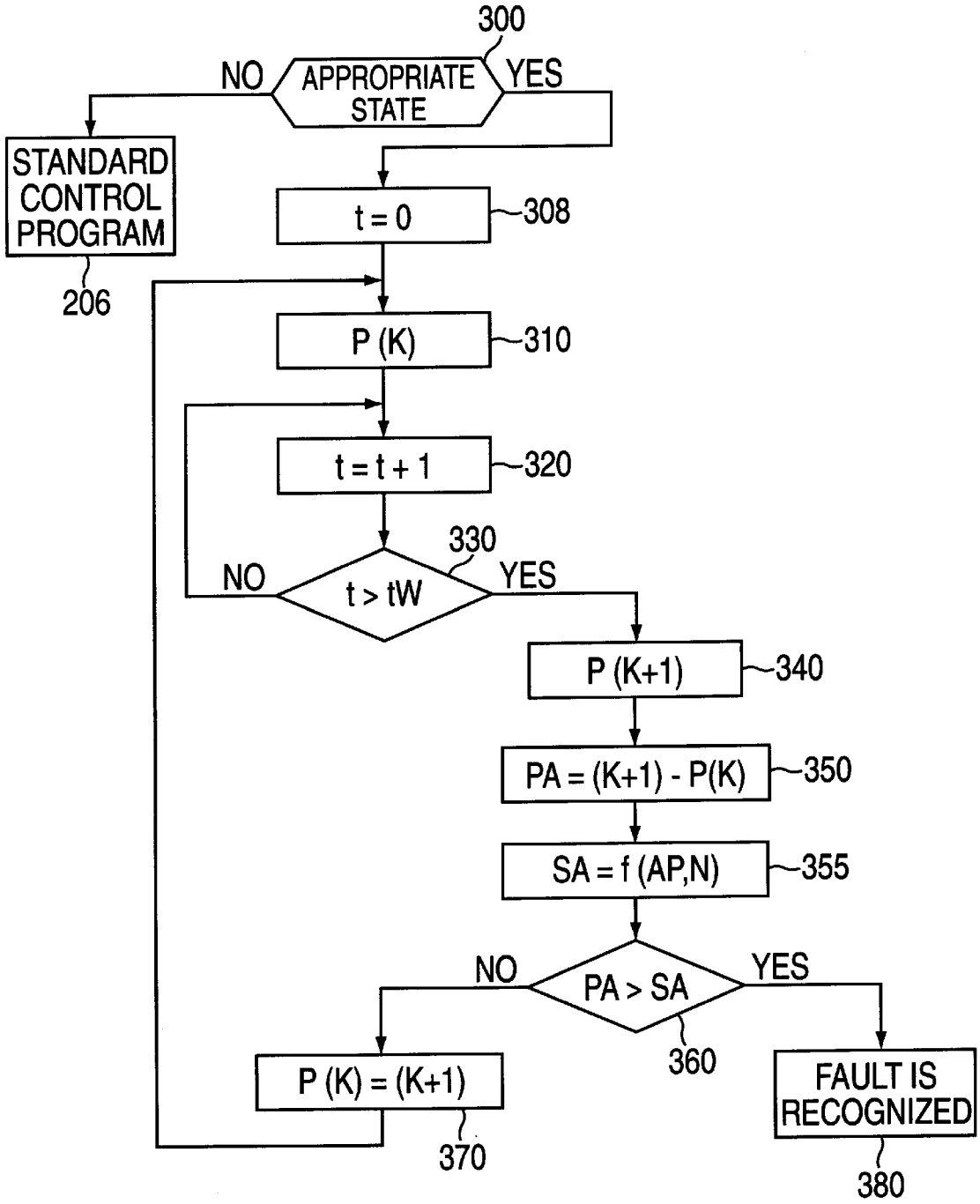
FIG. 3 shows a flow diagram of a second embodiment of the method according to the present invention.

Furthermore, a verification can be made as to whether boost pressure P rises by more than a tolerance value SA within a definable time period TW, which is described in an embodiment of a method according to the present invention shown in FIG. 3 as a flow diagram. A first query 300 checks whether an appropriate state exists in which fault recognition can be performed. This check takes place as described in FIG. 2, by processing of queries 201 to 205.

If an appropriate operating state exists, step 308 then follows. In step 308, a time counter t is set to 0. In the subsequent step 310, sensor 196 senses the boost pressure P(K). Then in step 320, time counter t is incremented by 1. The subsequent query 330 checks whether a waiting time TW has elapsed. If this is the case, step 320 occurs again.

After the waiting time tW has elapsed, a new value P(K+l) of the boost pressure is sensed in step 340. In step 350, the difference PA between the old value P(K) and the new value P(K+1) is formed. This difference PA is an indication of the change in pressure, e.g., an increase in pressure, during the waiting time TW.

The subsequent query 360 checks whether the difference PA is greater than a threshold value SA. The threshold value SA was determined previously in step 355 on the basis of various magnitudes such as, for example, the triggering signal AP and engine speed N. The value SA is preferably acquired from a characteristics diagram. In step 370 the new value P(K+1) is overwritten over the old value P(K) if the difference PA is smaller or equal to the threshold value SA. Query 360 then follows, in which if it is recognized that an increase in boost pressure was greater than a permissible value SA, step 380 then generates a fault and initiates the corresponding actions, as described in FIG. 2.

It is also advantageous if the two actions are combined with one another, i.e. if both conditions are checked. A further advantageous solution consists in the fact that one and/or both conditions are combined, as additional fault recognition, with other methods for fault recognition.

What is claimed is:

1. A method for monitoring an operating condition of an internal combustion engine, comprising the steps of:

measuring an intake duct boost pressure of a fuel metering system of the internal combustion engine; and detecting a fault in the fuel metering system only if a fuel quantity to be injected is 0 and if at least one of i) a measured value of the boost pressure is greater than a predetermined value, and ii) the measured value rises at a rate greater than a predetermined rate.

2. The method according to claim 1, wherein the predetermined value is a definable threshold value.

3. The method according to claim 2, further comprising the step of:

determining the definable threshold value as a function of at least one triggering signal, the at least one triggering signal being applied to an actuator, the actuator influencing the boost pressure.

4. The method according to claim 1, further comprising the step of:

determining the predetermined rate as a function of at least one of a speed of the internal combustion engine and a triggering signal applied to an actuator, the actuator influencing the boost pressure.

5. The method according to claim 1, further comprising the steps of:

detecting the fault when the internal combustion engine is in a coasting mode.

6. The method according to claim 1, further comprising the step of:

when the fault is detected, initiating predetermined fault actions to reduce a power output of the internal combustion engine.

7. The method according to claim 1, wherein the internal combustion engine includes an auto-ignition internal combustion engine.

8. An apparatus for recognizing a fault in an internal combustion engine, comprising:

a boost pressure sensor measuring an intake duct boost pressure of a fuel metering system of the internal combustion engine; and a control system connected to the boost pressure sensor, wherein, when a fuel is cut off, the control system detects the fault in the fuel metering system if at least one of i) the boost pressure is greater than a predetermined value, and ii) the boost pressure rises at a rate greater than a predetermined rate.

9. The apparatus according to claim 8, wherein the predetermined value is a definable threshold value.

10. The apparatus according to claim 9, wherein the definable threshold value is defined as a function of at least one triggering signal, the at least one triggering signal being applied to an actuator, the actuator influencing the boost pressure.

11. The apparatus according to claim 8, wherein the predetermined rate is determined as a function of at least one of a speed of the internal combustion engine and a triggering signal applied to an actuator, the actuator influencing the boost pressure.

12. The apparatus according to claim 8, wherein the fault is detected when the internal combustion engine is in a coasting mode.

13. The apparatus according to claim 8, wherein, when the fault is detected, predetermined fault actions are initiated to reduce a power output of the internal combustion engine.

14. The apparatus according to claim 8, wherein the internal combustion engine includes an auto-ignition internal combustion engine.

* * * * *